US007532854B2

(12) United States Patent
Shin

(10) Patent No.: US 7,532,854 B2
(45) Date of Patent: May 12, 2009

(54) IMAGE FORMING APPARATUS INCLUDING DISCHARGING ROLLER DECELERATING UNIT AND METHOD OF DECELERATING DISCHARGING ROLLER

(75) Inventor: Dae-lim Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 266 days.

(21) Appl. No.: 11/436,634

(22) Filed: May 19, 2006

(65) Prior Publication Data

US 2006/0263130 A1 Nov. 23, 2006

(30) Foreign Application Priority Data

May 20, 2005 (KR) ..... 10-2005-0042461

(51) Int. Cl.
*G03G 15/00* (2006.01)

(52) U.S. Cl. ..... 399/405

(58) Field of Classification Search ..... 399/405
See application file for complete search history.

(56) References Cited

U.S. PATENT DOCUMENTS 4,693,431 A 9/1987 Kataoka
5,882,130 A * 3/1999 Kumazaki et al. ..... 400/642
6,473,590 B2 * 10/2002 Matsumoto et al. ..... 399/404

FOREIGN PATENT DOCUMENTS

| | | |
|---|---|---|
| JP | 62-070159 | 3/1987 |
| JP | 62-218162 | 9/1987 |
| JP | 08-073108 | 3/1996 |
| KR | 100205595 B1 * | 4/1999 |

* cited by examiner

*Primary Examiner*—Anthony H Nguyen
*Assistant Examiner*—Andy L Pham
(74) *Attorney, Agent, or Firm*—Stein, McEwen & Bui, LLP

(57) ABSTRACT

An image forming apparatus includes a discharging roller decelerating unit and a method of decelerating discharging rollers. The image forming apparatus includes a print unit, discharging rollers, a sensor unit that sensing a trailing edge of paper, and the discharging roller decelerating unit. The method includes detecting a trailing edge of paper using a sensor unit and decelerating the discharging rollers after a predetermined period of delay time subsequent to the sensing of the trailing edge of the paper. Accordingly, even when there is a difference between the sensing moments of the trailing edge of the paper, the decelerating moments of the discharging rollers are stabilized, and thus the paper can be uniformly stacked regardless of double-sided printing or single-sided printing, even when the paper is discharged at a high speed.

9 Claims, 5 Drawing Sheets

IMAGE FORMING APPARATUS INCLUDING DISCHARGING ROLLER DECELERATING UNIT AND METHOD OF DECELERATING DISCHARGING ROLLER

CROSS-REFERENCE TO RELATED APPLICATIONS

This application claims the benefit of Korean Patent Application No. 2005-42461, filed May 20, 2005, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an image forming apparatus including a discharging roller decelerating unit, which allows documents to be uniformly stacked outside of a print unit after printing is complete, and a method of decelerating discharging rollers.

2. Description of the Related Art

An image forming apparatus, such as a printer or a copier, discharges a document on which a print has been performed using discharging rollers and stacks the document in a discharge tray. When the operating speed of the image forming apparatus increases, a document is discharged at a faster rate. In a high-speed image forming apparatus, documents are discharged to the discharge tray at a high speed, and this high speed frequently results in documents being non-uniformly stacked in the discharge tray.

It is preferred that the sheets of printed documents which are discharged at a high speed are uniformly stacked in the discharge tray. There are various methods for solving the above problem. For example, there is a method of reducing the rotation speed of the discharging rollers just before the document is discharged to the outside of a print unit. A decelerating moment of the discharging rollers is determined by a sensor that senses a trailing edge of the document. U.S. Pat. No. 4,693,431 discloses a device for controlling a discharging speed, which includes a paper detecting sensor and discharging rollers.

The document S curls up during printing, due to the document S experiencing the high pressure and temperature of fixing rollers. If the amount of curling in the trailing edges of the documents varies from one document to another, the trailing edge of different documents may pass by a sensing reference point of the sensor at different times, even if the documents have the same size. Consequently, the discharging roller decelerating moments should vary depending on how much curling of the documents takes place, in order to discharge every document uniformly. Otherwise, when the trailing edges of the documents curl up differently according to whether double-sided printing or single-sided printing is performed, the documents may not be uniformly stacked in the discharge tray.

SUMMARY OF THE INVENTION

Aspects of the present invention provide an image forming apparatus including a discharging roller decelerating unit which allows documents to be uniformly stacked by controlling a period of delay time to stabilize the decelerating moment of discharging rollers according to whether single-sided or double-sided printing is performed on the documents, and a method of decelerating the discharging roller.

According to one aspect of the present invention, there is provided an image forming apparatus comprising a print unit which prints an image on a document, one or more discharging rollers which discharge the printed document to a discharge tray, a sensor unit installed at a portion of the print unit where the document is discharged which senses a trailing edge of the document, and a discharging roller decelerating unit which decelerates the discharging rollers after a predetermined period of delay time subsequent to the sensing of the trailing edge of the document, wherein the period of delay time is set to a different value according to whether double-sided (duplex) printing or single-sided printing is performed on the document.

According to another aspect of the present invention, there is provided a method of decelerating discharging rollers comprising detecting a trailing edge of a document by using a sensor unit installed at a portion of the print unit where the document is discharged, and decelerating discharging rollers that discharge the document after a predetermined period of delay time subsequent to the sensing of the trailing edge of the document, wherein the period of delay time is set to a different value according to whether double-sided printing or single-sided printing is performed.

The sensor unit may comprise a document contact arm which rotates while contacting the document, and a sensor which senses that the document contact arm is returned back to a reference position after being separated from the document.

When double-sided printing is performed, in which the trailing edge of the document curls more than when single-sided printing is performed, the period of delay time may be set to be smaller than when single-sided printing is performed.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
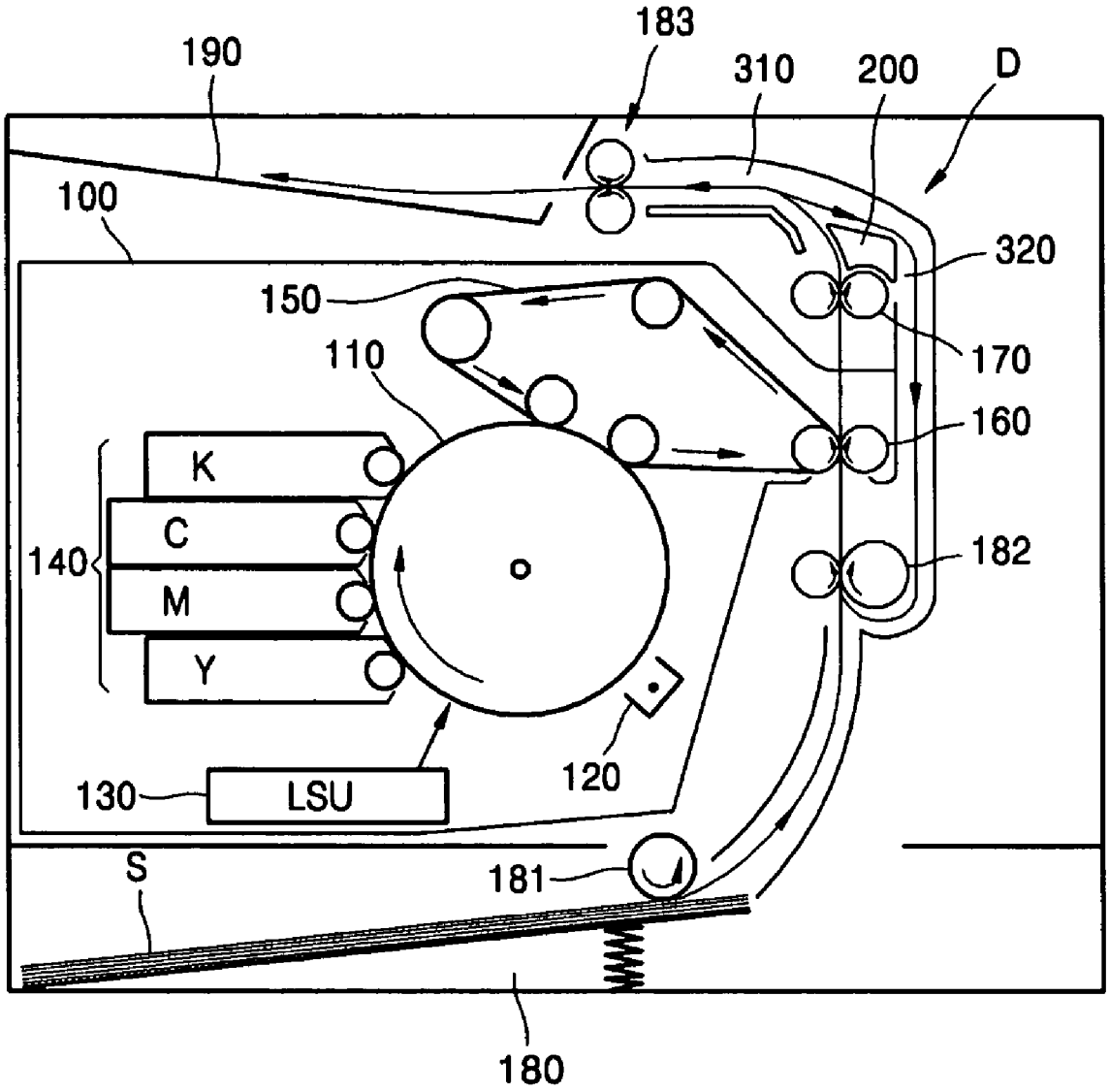
FIG. 1 is a side view of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a side view of an image forming apparatus according to an embodiment of the present invention, and includes a print unit 100, discharging rollers 183, a sensor unit that senses a trailing edge of a document, and a discharging roller decelerating unit. A method of decelerating discharging rollers according to an embodiment of the present invention includes detecting the trailing edge of the document using the sensor unit, and decelerating the discharging rollers when a predetermined period of delay time passes after the trailing edge is detected. The delay time is set differently according to whether single-sided printing or double-sided printing is performed.

Referring to FIG. 1, the print unit 100, fixing rollers 170, a discharging path 310, and a reversing path 320 are illustrated. The print unit 100 includes a photodetector 110, a charging unit 120, a scanning unit 130, a developing unit 140 that contains a developer, a transfer belt 150, and transfer rollers 160. According to an embodiment of the present invention, the print unit 100 capable of printing a color image includes four developing units containing black (K), cyan (C), magenta (M), and yellow (Y) developers. Although the image forming apparatus of FIG. 1 is a four-pass type color electrophotographic image forming apparatus, the present invention is not limited to this type and various types of image forming apparatuses can be used in accordance with the present invention.

The charging unit 120 charges the surface of the photodetector 110 with a particular electric potential. The scanning unit 130 forms, for example, a yellow (Y) electrostatic latent image by scanning light corresponding to yellow color image data onto the photodetector 110. The developing unit 140Y develops the electrostatic latent image into a yellow (Y) toner image. The yellow (Y) toner image is transferred to the transfer belt 150. In the same fashion, magenta (M), cyan (C), and black (K) toner images are sequentially transferred onto the transfer belt 150 to be overlapped with one another, and a full-color toner image is formed on the transfer belt 150.

A document S is drawn out from a document feed cassette 180 by a pickup roller 181, and then conveyed to the transfer belt 150 by a feed roller 182. The document S may be paper, but may also be other types of print media, such as overheads, transparencies, etc. The toner image is transferred from the transfer belt 150 to the document S. The toner image is transferred and fixed onto the document S by the fixing rollers 170. The fixing roller 170 includes a pressurizing roller 171 and a heating roller 172 (referring to FIG. 2), and fixes the toner image onto the document S by applying pressure and heat to the document S.

The discharging path 310 is formed between the fixing rollers 170 and the discharging rollers 183. The document S on which a print has been performed is discharged to a discharge tray along the discharging path 310. At least one of the discharging rollers 183 discharges the document S on which the print has been performed to the outside of the print unit 100. Sheets of discharged documents are successively stacked in the discharge tray 190.

The image forming apparatus may further include the reversing path 320 for printing on both sides of a document S. The document S on one side of which an image has been printed is reversed and transferred to the print unit along the reversing path 320 to print an image on the other side of the document S. The reversing path 320 is branched off from the discharging path 310 and extended to the feed roller 182 that feeds a document S to the print unit 100.

The document S passing through the fixing rollers 170 is conveyed along the discharging path 310. The sensor unit senses that the trailing edge of the document S passes a sensing reference point. After a predetermined period of delay time, the discharging rollers 183 decelerate just before the trailing edge of the document S is discharged to the outside of the print unit 100. Since the document S conveyed in a discharging direction at a high speed is decelerated just before being stacked in the discharge tray 190 outside of the print unit 100, the document S can be uniformly stacked.

Figure 2:
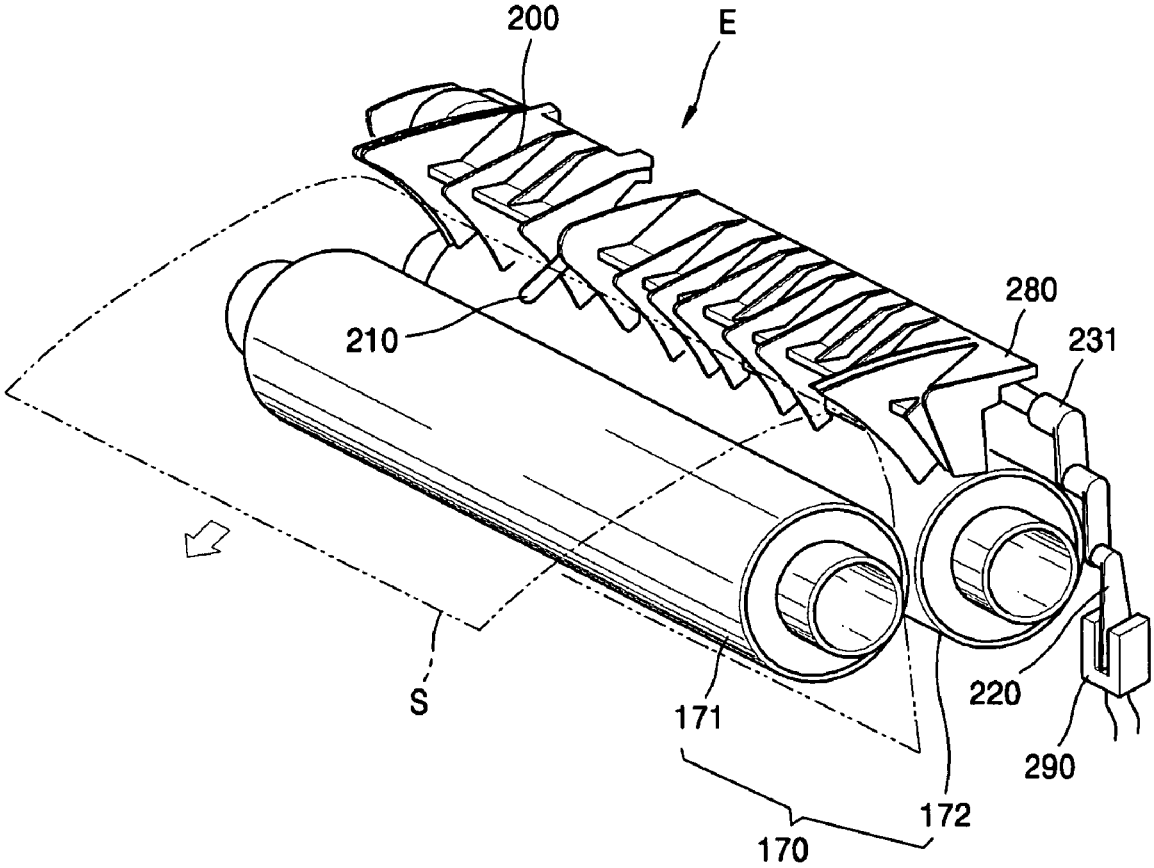
FIG. 2 is a perspective view illustrating in detail a part 'D' of FIG. 1.
Figure 3:
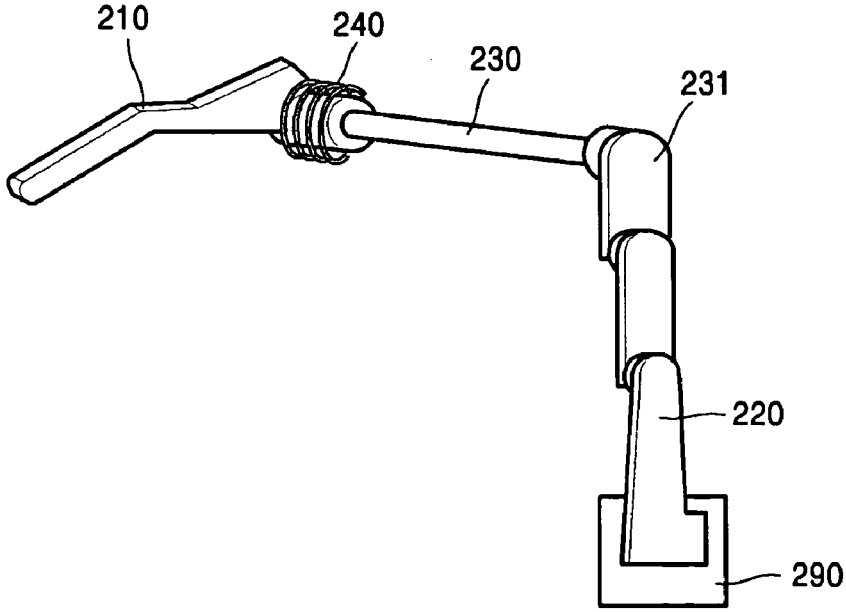
FIG. 3 is a perspective view illustrating in detail a sensor unit denoted by 'E' in FIG. 2.

FIG. 2 is a perspective view illustrating in detail part 'D' of FIG. 1, and FIG. 3 is a perspective view illustrating in detail the sensor unit denoted by 'E' in FIG. 2. Hereinafter, an embodiment of the sensor unit will be described.

Referring to FIGS. 2 and 3, a frame 280 is disposed above the fixing rollers 170, and a guide member 200 is integrally formed with the frame 280. The guide member 200 guides the document S, which has been discharged from the fixing rollers 170, to the discharging path 310. A rotation member 230 is pivotably installed in the frame 280, and a document contact arm 210 is connected to the rotation member 230. A sensor operating arm 220 is installed on an end 231 of the rotation member 230. The sensor operating arm 220, rotating together with the document contact arm 210, turns a sensor 290 on or off. The sensor 290 is turned on or off depending on whether the document S is discharged from the fixing rollers 170 and loses contact with the document contact arm 210. The sensor 290 may be an optical sensor or a micro-switch. However, the sensor 290 is not limited to these two types of sensors, and other types of sensors may also work in accordance with aspects of the present invention.

As an embodiment of the sensor unit, a light shielding unit (not shown) is installed on an end of the sensor operating arm 220, and the sensor 290 is installed around the light shielding unit. Although not illustrated, the sensor 290 includes a light emitting sensor and a light receiving sensor. The light shielding unit reflects the light so that the light flows from the light emitting sensor to the light receiving sensor. The sensor 290 is in a turned-ON state when the document contact arm 210 and the sensor operating arm 220 are at a reference position where the rotation angle of the document contact arm 210 is zero degrees in relation to its position when it is not making contact with the document. The rotation angle is zero when the document contact arm 210 is not making contact with the document S.

A leading end of the document contact arm 210 is extended to a position where a document S is discharged from the fixing rollers 170. When the document S is discharged from the fixing rollers 170, the document contact arm 210 makes contact with the document S and rotates from its reference position due to the restitution force of the document S, turning off the sensor 290.

Referring to FIG. 3, an elastic member 240 may be installed to elastically bias the document contact arm 210 toward the document S. The elastic member 240 may be a torsion spring connected to the rotating member 230. The elastic member 240 provides the document contact arm 210 with a contact force against the printed document, and returns the document contact arm 210 back to its reference position. The elastic member 240 is not limited to being a torsion spring, and other types of elastic members can be used in accordance with aspects of the present invention.

Figure 4A:
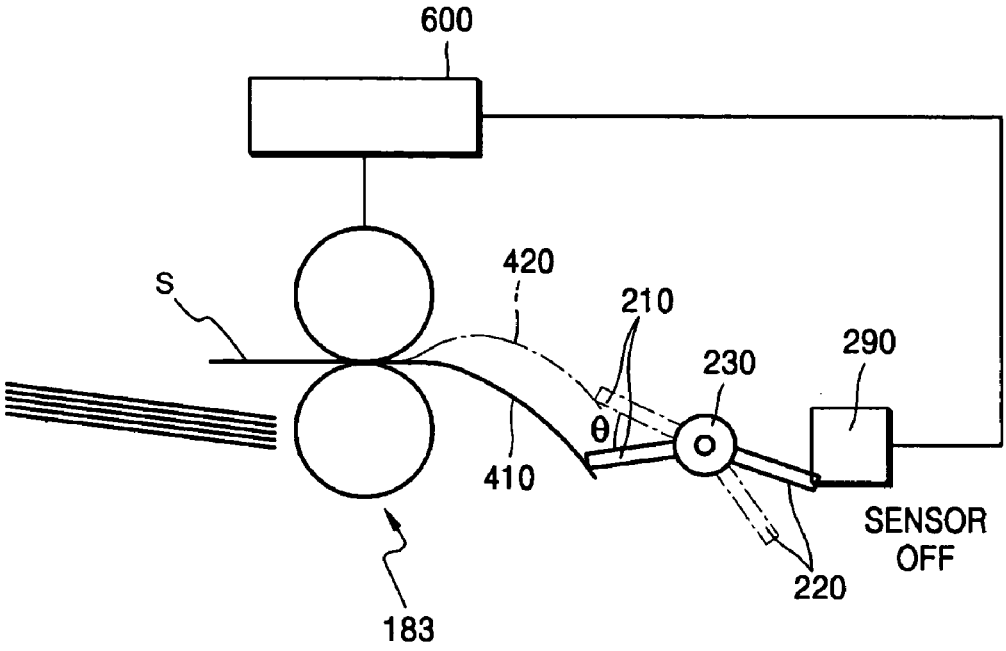
FIGS. 4A and 4B are views of a discharging roller decelerating unit when a pair of discharging rollers are included in the image forming apparatus of FIG. 1 and the sensor unit is turned off and on, respectively.
Figure 4B:
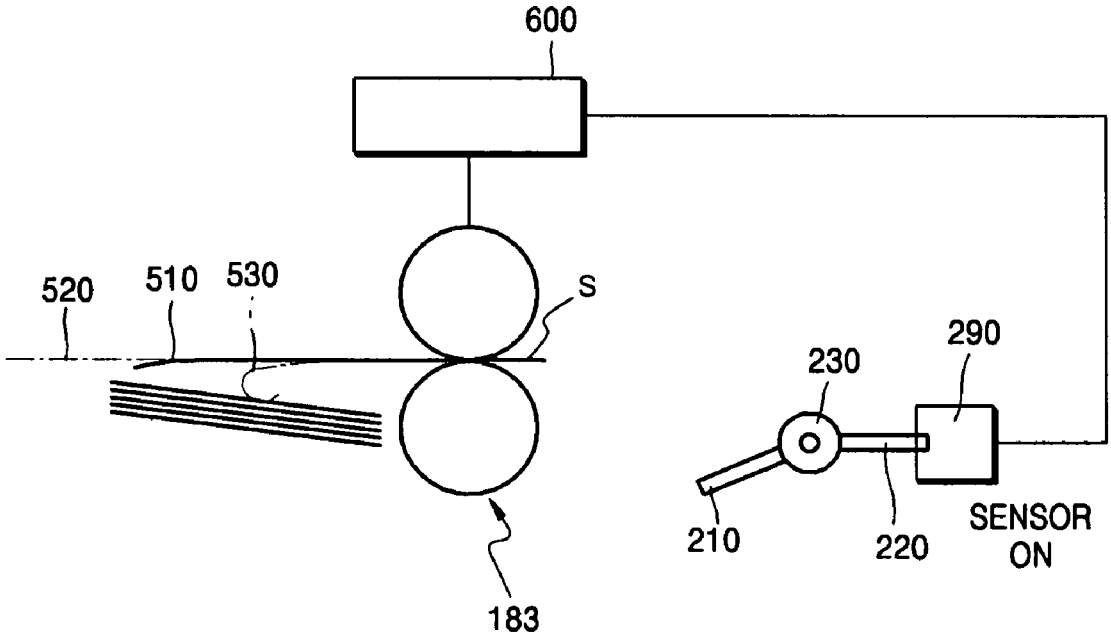

FIGS. 4A and 4B are views of operations of a discharging roller decelerating unit 600 when a pair of discharging rollers 183 is included in the image forming apparatus. The elements are exaggerated for illustration purposes. FIG. 4A illustrates a state at the moment just before the trailing edge of a document S is separated from the leading end of the document contact arm 210. FIG. 4B illustrates a state at the moment just before the document S is discharged from a pair of discharging rollers 183 to the outside of the print unit 100.

When the document contact arm 210 rotates away from the reference position due to the restitution force of the document S, the sensor 290 stays in an OFF state, as illustrated in FIG. 4A. When the document contact arm 210 is returned to its reference position, the sensor is turned ON, as illustrated in FIG. 4B. Hereinafter, a first point of time is defined as the moment when the sensor 290 senses the trailing edge of the document S. This first point of time is not the moment when the trailing edge of the document S is separated from the leading end of the document contact arm 210, but the moment when the document contact arm 210 is returned back to its reference position so that the sensor 290 is turned ON. The time required for the document contact arm 210 to be returned back to its reference position is proportional to the rotation angle of the document contact arm 210.

When printing is performed on a single side of the document S, the document S passes through the fixing rollers 170 once, and when printing is performed on both sides of the document S, the document S passes through the fixing rollers 170 twice. Thus, the document S curls up more during double-sided printing than during single-sided printing, due to the document S experiencing the high pressure and temperature of the fixing rollers 170 twice, instead of once. Reference numeral 410 denotes curling of the trailing edge of the document S, on which a print has been performed on one side only, and reference numeral 420 denotes curling of the trailing edge of the document S, on which prints have been performed on both sides of the document S. In the case of double-sided printing, the rotation angle of the document contact arm 210 at the moment just before the trailing edge of the document S is separated from the leading end of the document contact arm 210 is larger than single sided printing by an amount Θ due to the greater amount of curling experienced by the document on which prints have been performed on both sides.

FIG. 4B illustrates the stacking state of the leading edge of document S at the moment of deceleration of the discharging rollers 183. When the discharging speed of the document S is fast, the document S is discharged in an almost straight form. Particularly, when the discharging speed of the document S is excessively fast, the leading edge of the document S moves past a predetermined stacking position so that the document S is improperly stacked, as represented by reference numeral 520. When the discharging speed of the document S is too slow, the leading edge of the document S droops, as represented by a reference numeral 530, and this drooping document S can push previously stacked documents out of their uniformly stacked position, cause a paper jam, or do both.

In a high-speed image forming apparatus, although the discharging speed of the document S is very fast, the document S can be stacked at the position 510 if the rotating speed of the discharging rollers 183 decelerates just before the trailing edge of the document S passes through the discharging rollers 183. Therefore, the moment when the discharging rollers 183 start to decelerate is determined by adding a predetermined period of delay time to the first point of time in which the sensor 290 senses the trailing edge of the document S.

In the case where two documents have the same size but their trailing edges are curled differently, the one document that has a more curled trailing edge creates a greater rotation angle of the document contact arm 210, and therefore the first point of time of the one document with the more curled trailing edge is delayed more than the first point of time of the other document with the less curled trailing edge, even if the positions of the two leading edges of the documents are the same. When this period of delay time for the document with a more curled trailing edge is added to the first point of time for the document with a more curled trailing edge, the decelerating moment is further delayed. Therefore, the leading edge of the document moves past the predetermined stacking position and is non-uniformly stacked into the discharge tray 190, as represented by reference numeral 520.

When printing is performed on both sides of the document S, the period of delay time may be set to be smaller than the period of delay time for single-sided printing because the trailing edge of the document S curls more in double-sided printing than in single-sided printing. When the first point of time is further delayed in double-sided printing, the period of delay time is set to be smaller than in single-sided printing. Accordingly, the decelerating moments of the discharging rollers 183 for both double-sided printing and single-sided printing are almost the same, and thus the document is uniformly stacked, as represented by reference numeral 510.

Preferably, the period of delay time for double-sided printing may be set to be smaller than the period of delay time for single-sided printing by a 10-30 millisecond (ms) difference.

Equation 1

Period of delay time when double-sided printing=period of delay time when single-sided printing+α

When a sheet of normal paper with a thickness of 0.08~0.11 mm, a sheet of abnormally thick paper with a thickness of 0.16~0.52 mm, and an envelope are printed on both sides are discharged, experimental results using Equation 1 are as follows:

$$\text{when } \alpha=0\sim20 \text{ ms}, \quad (1)$$

the discharging rollers 183 start to decelerate after the paper is completely discharged to the outside of the image forming apparatus, and the paper passes over a desired stacking position, as represented by reference numeral 520.

$$\text{when } \alpha=-30\sim-10 \text{ ms}, \quad (2)$$

the discharging rollers 183 start to decelerate while the paper is being discharged to the outside of the image forming apparatus, and all of the paper is stacked at a desired stacking position, as represented by reference numeral 510.

$$\text{when } \alpha=-50\sim-40 \text{ ms}, \quad (3)$$

the discharging rollers 183 completely decelerate before a part of the paper begins to be discharged to the outside of the image forming apparatus, and a leading edge of the paper droops to push the previously stacked paper forward, as represented by reference numeral 530.

Figure 5A:
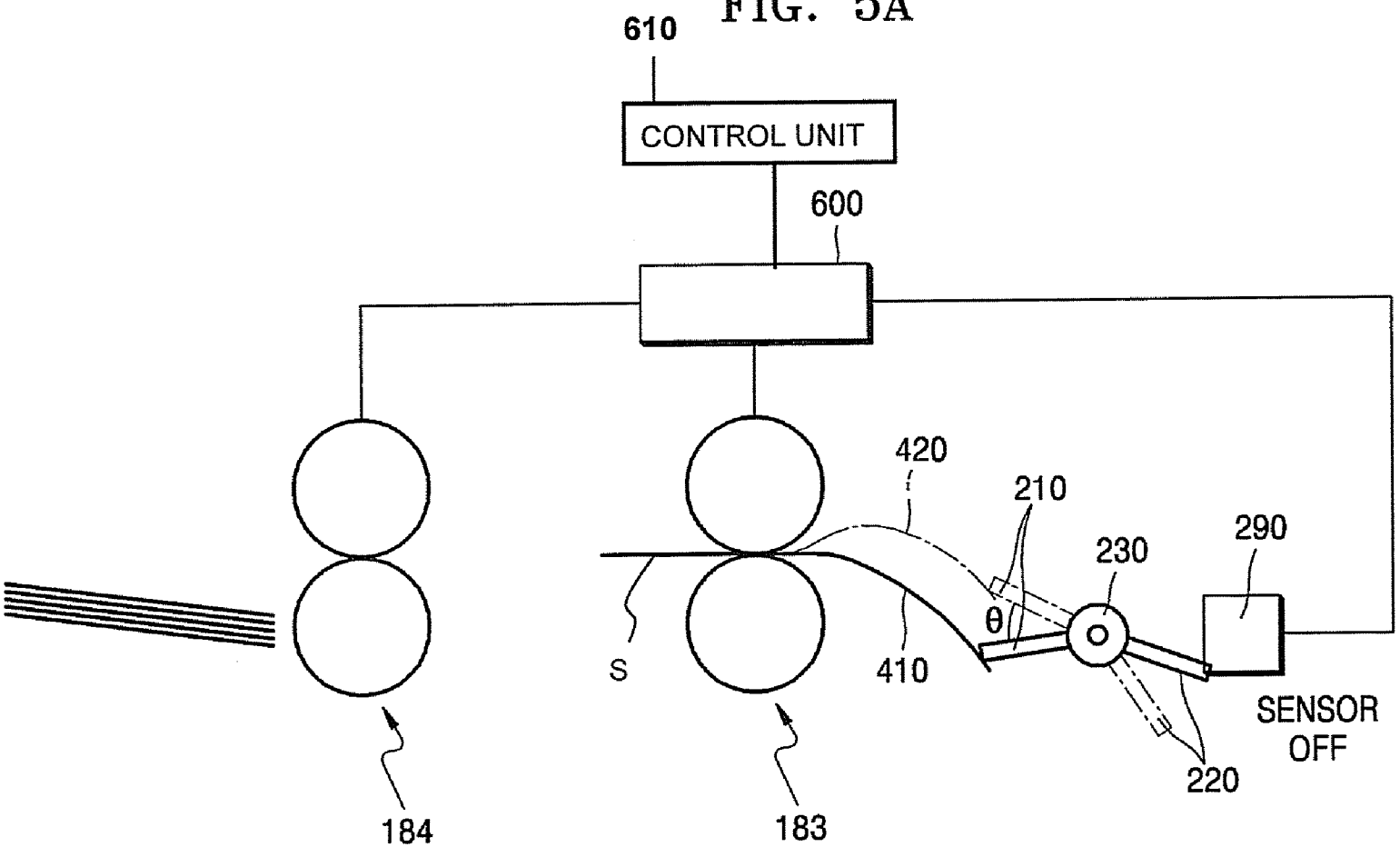
FIGS. 5A and 5B are views of the discharging roller decelerating unit when two pairs of discharging rollers are included in the image forming apparatus of FIG. 1 and the sensor unit is turned off and on, respectively.
Figure 5B:
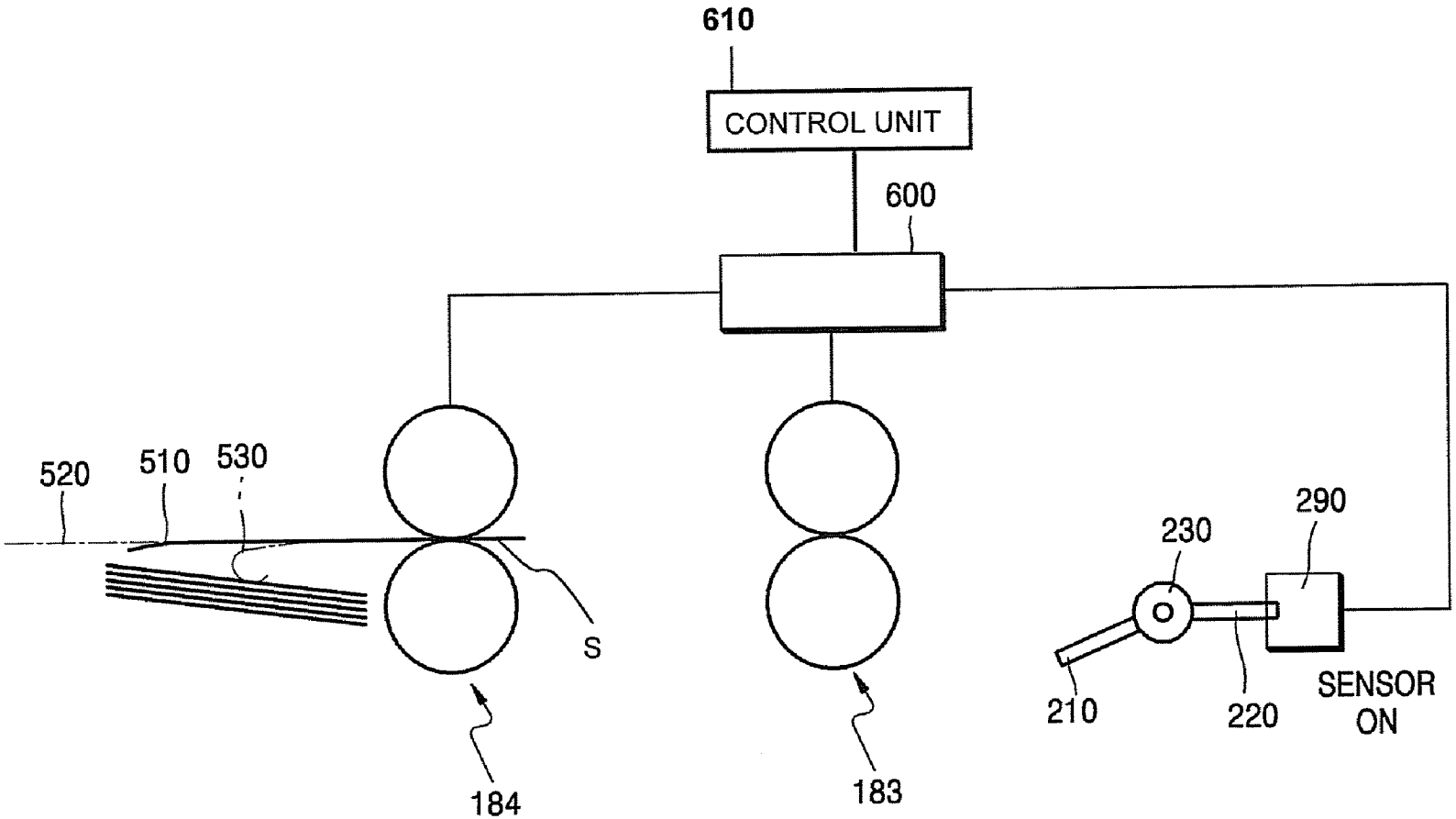

FIGS. 5A and 5B are views of operations of the discharging roller decelerating unit 600 when two pairs of discharging rollers 183 and 184 are included in the image forming apparatus. FIG. 5A illustrates a state at the moment just before a trailing edge of a document S is separated from a leading end of the document contact arm 210. FIG. 5B illustrates a state at the moment just before the document S is discharged to the discharge tray 190 outside of the print unit 100 of FIG. 1. When the two pairs of discharging rollers 183 and 184 are installed in the image forming apparatus, the discharging rollers 184, which discharge the document S to the discharge tray 190 and are installed in the last part of the image forming apparatus, decelerate the document S.

Although not illustrated, in contrast to the above mentioned embodiment, the sensor unit may detect the first point of time earlier in spite of the double-sided printing when the trailing edge of a document curls more. For example, this is when the sensor unit includes a light emitting sensor and a light receiving sensor which directly senses the trailing edge of the document by the difference of a light intensity which penetrates the document from the light emitting sensor to the light receiving sensor. The light emitting sensor and the light receiving sensor are located at the sensing reference point which is in the upper stream of a pair of discharging rollers, such as the pair of discharging rollers 183 in FIG. 1. In this case, when two documents have the same size but the trailing edges are curled differently, the lengths of the two documents, measured along a virtual straight line from the leading edge to the trailing edge, are different, so that the first point of time of the document that has a less curled trailing edge is further delayed even if the positions of the leading edges of the documents are the same. This is because the light emitting sensor and the light receiving sensor senses earlier that the trailing edge of the document passes the sensing reference point even when the trailing edge curls more. If the same period of delay time is added to the earlier first point of time, the decelerating moment is earlier and the leading edge of the document droops so that the document may push the previously stacked document forward or cause a paper jam.

In this case, specifically, the situation when double-sided printing causes the trailing edges of the documents to curl more than the trailing edges of the documents would curl in single-sided printing, the first point of time is earlier, and the discharging roller decelerating unit 600 may lengthen the period of delay time for the decelerating moment to be stabilized so that the documents are uniformly stacked.

The discharging roller decelerating unit 600 may include a step motor (not shown) that drives the discharging rollers 183 and 184 and can control the rotation speed in a short time. The discharging rollers 183 and 184 and the sensor 290 are connected to the discharging roller decelerating unit 600. The discharging roller decelerating unit 600 may also include other types of motors, and is not limited to use of a step motor.

The discharging roller decelerating unit 600 may include a control unit 610. The control unit 610 stores the period of delay time appropriate for the type of the sensor 290 of the discharging roller decelerating unit 600 according to whether double-sided printing or single-sided printing is performed. The control unit 610 selects the appropriate period of delay time and calculates the optimal decelerating moment of the discharging rollers 183 and 184. The control unit 610 decelerates the discharging rollers 183 and 184 at the calculated moment by controlling the rotation of the step motor.

As described above, according to aspects of the present invention, in an image forming apparatus including a discharging roller decelerating unit and a method of decelerating discharging rollers, the discharging roller decelerating unit stabilizes a decelerating moment of discharging rollers even when trailing edges of documents are sensed at different moments depending on whether single-sided printing or double-sided printing is performed. Therefore, documents can be uniformly stacked regardless of whether the documents undergo single-sided printing or double-sided printing.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a print unit which prints an image on a document;

discharging rollers which discharge the printed document into a discharge tray;

a sensor unit which senses a trailing edge of the document;

a decelerating unit which decelerates the discharging rollers;

a step motor which rotates the discharging rollers; and a control unit which stores predetermined periods of delay time for double-sided and single-sided printing and controls the decelerating unit to control a rotational speed of the step motor to decelerate the discharging rollers after the corresponding stored predetermined period of delay time subsequent to the sensor unit sensing a trailing edge of the document according to whether the double-sided or the single-sided printing is performed on the document, wherein the predetermined period of delay time for double-sided printing is shorter than the predetermined period of delay time for single-sided printing.

2. The image forming apparatus of claim 1, wherein the sensor unit comprises:

a document contact arm which is moved from a reference point when contacted by the document; and a sensor which senses when the document contact arm is at the reference point.

3. The image forming apparatus of claim 2, wherein the sensor unit further comprises:

a frame where the sensor unit is attached;

a rotation member pivotally installed in the frame and connected to the document contact arm; and a sensor operating arm connecting the rotation member to the sensor, wherein the document contact arm rotates when contacting the document, thereby causing the sensor operating arm to rotate and turn the sensor on or off.

4. The image forming apparatus of claim 3, further comprising an elastic member connected to the document contact arm and the rotation member, wherein the elastic member elastically biases the document contact arm toward the document and returns the document contact arm to the reference point when the document contact arm loses contact with the document.

5. The image forming apparatus of claim 4, wherein the elastic member is a torsion spring.

6. The image forming apparatus of claim 1, wherein the predetermined period of delay time for double-sided printing is 10 to 30 milliseconds shorter than the predetermined period of delay time for single-sided printing.

7. A method of decelerating discharging rollers of an image forming apparatus, comprising:

detecting a trailing edge of a document by using a sensor unit installed on a print unit where the document is discharged; and decelerating discharging rollers that discharge the document after a predetermined period of delay time subsequent to the sensor unit sensing the trailing edge of the document, wherein the predetermined period of delay time is different depending on whether double-sided printing or single-sided printing is performed.

8. The method of claim 7, wherein the predetermined period of delay time for double-sided printing is shorter than the predetermined period of delay time for single-sided printing.

9. The method of claim 8, wherein the predetermined period of delay time for double-sided printing is 10 to 30 milliseconds shorter than the predetermined period of delay time for single-sided printing.

* * * * *